United States Patent [19]

Andrews

[11] 4,310,150

[45] Jan. 12, 1982

[54] WORKBENCH

[75] Inventor: Reginald W. D. Andrews, London, England

[73] Assignee: Black & Decker Inc., Newark, Del.

[21] Appl. No.: 948,852

[22] Filed: Oct. 5, 1978

[51] Int. Cl.[3] ..... B25B 1/10

[52] U.S. Cl. ..... 269/139; 269/220; 269/244; 269/261; 269/901

[58] Field of Search ..... 269/139, 219, 220, 221, 269/244, 258, 222, 321 CF, 283, 261

[56] References Cited

U.S. PATENT DOCUMENTS

| | | | |
|---|---|---|---|
| 985,857 | 3/1911 | Thomas . | |
| 1,348,148 | 8/1920 | Bergstrom | 269/258 |
| 1,716,718 | 6/1929 | Castagna . | |
| 3,861,664 | 1/1975 | Durkee | 269/258 |
| 4,157,174 | 6/1979 | Hickman et al. | 269/139 |

OTHER PUBLICATIONS

Sears Owners Manual, Model No. 113.288770; May-1978.

*Primary Examiner*—Robert C. Watson

*Attorney, Agent, or Firm*—Walter Ottesen; Leonard Bloom; Edward M. Murphy

[57] ABSTRACT

A workbench of a foldable, portable nature includes a working surface formed by a pair of vise bars. The vise bars are operated by a pair of clamping screws which are so interconnected with a movable one of the bars by connections which allow limited lateral movement of a nut, carried by one of the screws, and the movable vise bar to permit one clamping screw to be rotated at a different speed than the other clamping screw. The vise bars are carried by a supporting structure formed by two frame members, means being provided for retaining the frame members at an acute angle to each other in an erected position of the workbench and for enabling the frame member to lie adjacent each other in substantially parallel planes, when the frames are in a collapsed position of the workbench.

1 Claim, 5 Drawing Figures

WORKBENCH

BACKGROUND OF THE INVENTION

The present invention relates generally to the art of workbenches, and in particular to workbenches which are of foldable, portable nature.

The art includes many forms of workbench, some of which have a work surface formed by a pair of vise beams operated by a pair of vise operating screws.

SUMMARY OF THE INVENTION

According to one aspect of the present invention, a workbench has a working surface which is formed by a pair of vise bars which are supported from below by a support structure, a pair of clamping screws for moving the vise bars together to clamp a workpiece therebetween, the clamping screws being spaced apart and generally parallel, and each engaging in a nut connected to a movable one of the vise bars, the connection between at least one nut and the movable vise bar allowing limited lateral movement between the nut and the movable vise bar to permit one clamping screw to be rotated at a different speed than the other clamping screw.

A vertical pin may extend upwards from each nut, at least one of the pins engaging in a transverse slot in the movable bar, and the slot preferably extends substantially parallel to the length of the vise bar. The movable one of the vise bars may be removable by lifting from the connections between it and the nuts.

According to another aspect of the present invention, a workbench has a support structure comprising a horizontal supporting member, a first frame member pivoted to the horizontal supporting member, a second frame member releasably coupled to the horizontal supporting member, and means for retaining the first and second frame members at an acute angle to each other in the erected position of the workbench and for enabling the first and second frame members to lie adjacent each other in substantially parallel planes when the second frame member is released from the horizontal supporting member in the collapsed position of the workbench. The retaining means may be a linkage connection, having a first link pivoted to the first frame member, a second link pivoted to the first link and to the second frame member and a third link pivoted to the first frame member and to the second link.

According to a further aspect of the present invention, a workbench has a top structure comprising a pair of spaced horizontal elongate beams and a pair of underlying transverse supports, the top structure being carried by a foldable understructure which includes front and rear frames each comprising a pair of legs and at least one interconnecting bar, and each leg having a telescopic extension whereby, with the extensions withdrawn and extended respectively the top structure can be maintained at lower and upper levels.

According to yet another aspect of the present invention, a workbench has a top structure comprising a pair of spaced horizontal elongate beams and a pair of underlying transverse supports, the top structure being carried by a foldable understructure which includes front and rear frames each comprising a pair of legs and at least one interconnecting bar, each leg including an upper portion which extends downwards and inwards, and a lower portion which extends downwards and outwards with a floor engaging portion at its lower end.

BRIEF DESCRIPTION OF THE DRAWINGS

The invention may be carried into practice in various ways but one specific embodiment will now be described by way of example, with reference to the accompanying drawings, in which.

DESCRIPTION OF THE PREFERRED EMBODIMENT

Figure 1:
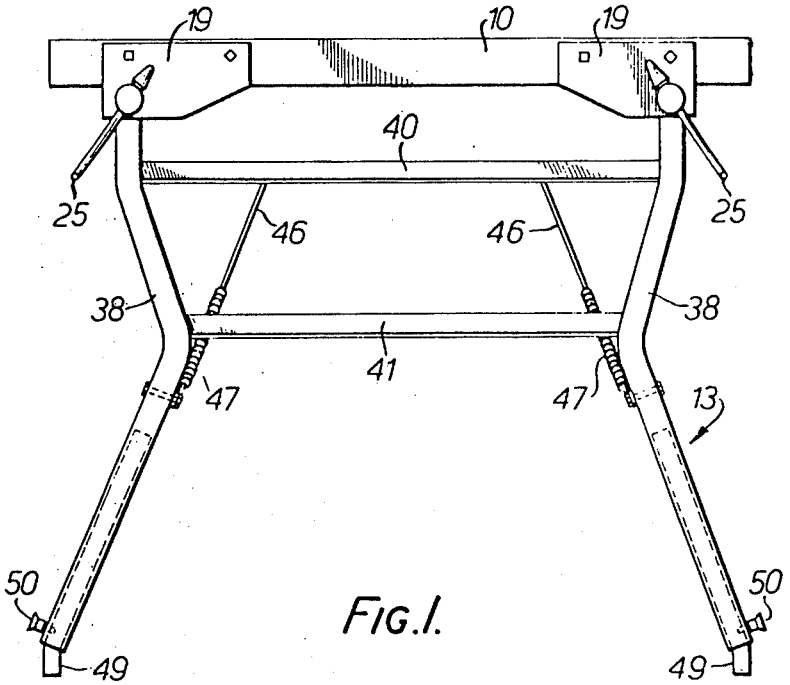
FIG. 1 is a front elevation of a workbench according to the invention.
Figure 2:
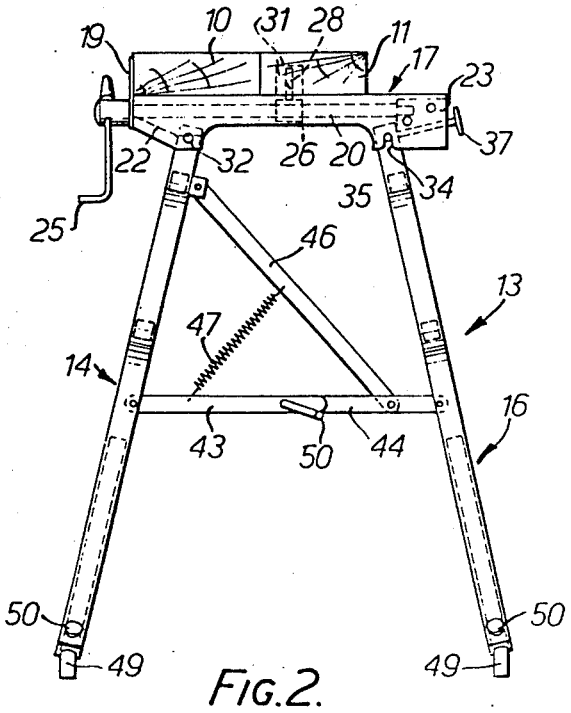
FIG. 2 is a side elevation in the erect position.
Figure 3:
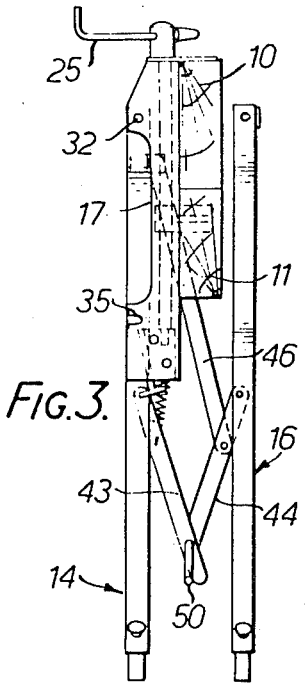
FIG. 3 is a side elevation in the folded position.

The workbench as shown in the drawings includes a front fixed vise member 10, a rear movable vise member 11 and a supporting structure 13 which includes a front frame 14, a rear frame 16 and a pair of horizontal channel members 17 which support the vise members 10 and 11.

Each channel member 17 is provided at its front end with an end plate 19 which projects above the level of the channel member 17 and has bolted thereto the front vise member 10.

The front vise member 10 is thus maintained in a fixed position relative to the supporting structure 13.

A feed screw 20 passes along the length of each channel member 17 and is supported at each end in front and rear bearing blocks 22, 23 which are secured in the channel member. The front end of the feed screw 20 passes through the front bearing block 22 and is provided with a handle 25 whereby the feed screw may be manually rotated. Means, not shown, is provided to fix each feed screw against axial movement.

Figure 4:
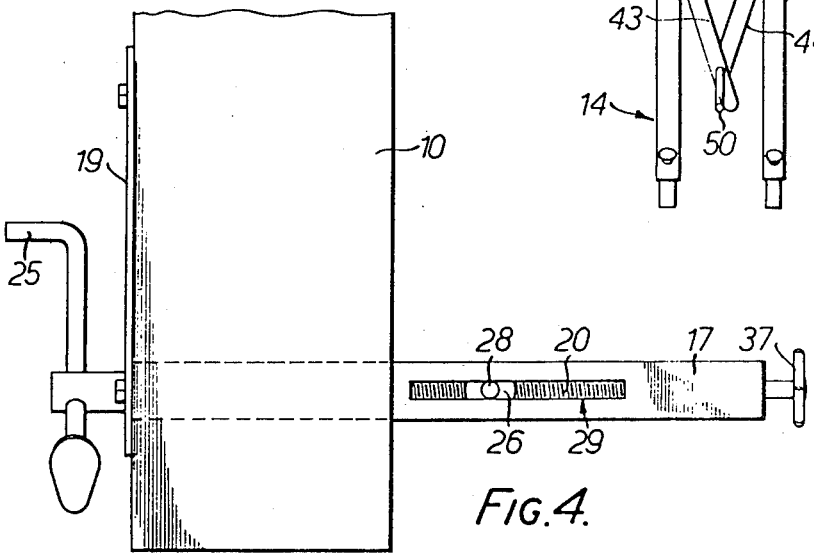
FIG. 4 is a plan view of one end of the workbench with the second vise member removed.
Figure 5:
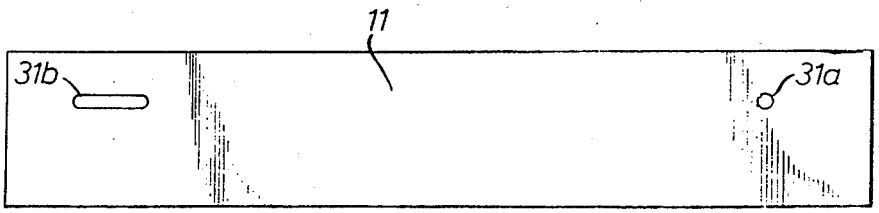
FIG. 5 is an under plan view of the second vise member.

Threaded to each feed screw 20 is a nut 26 having a stud 28 fixed thereto and extending upwards through a slot 29 in the upper surface of the channel member 17, (see FIG. 4). Each nut 26 is prevented, by means not shown, from rotation so that when one of the handles 25 is operated, the corresponding nut 26 and stud 28 are caused to move horizontally along the channel member 17. The second vise member 11 rests, in use, upon the upper surface of the channel member 17 with the stud 28 loosely located in a blind hole 31 formed in the under surface thereof. The vise member 11 is therefore provided with two such blind holes one for the stud 28 of each channel member 17. As shown in FIG. 5, one blind hole **31*a* is only just larger than the associated stud 28 while the other blind hole is in the form of a slot 31*b*. This structure enables one feed screw to be operated without the other whereby wedge-shaped workpieces may be clamped between the vise members 10 and 11. Such operation forms the subject of U.S. Pat. No. 1,267,032. Instead of the studs 28 being loosely received in the hole 31*a* and the slot 31*b*, they may extend into countersunk holes in the top of the bench and have screwthreaded ends to which securing nuts are attached, the nuts not being tightened to an extent which would prevent rotation with respect to the hole 31*a* and lateral shifting with respect to the slot 31*b***.

Each channel member 17 is permanently pivoted to the front frame 14 of the support structure by means of a pivot 32. The rear frame 16 is releasable secured to each channel member 17 by means of a pin 34 formed at the top end of the rear frame engaging in a slot 35 formed in the channel member 17 and held in position by a retaining screw 37 passing through the bearing block 23. Release of the retaining screw 37 and removal of the pin 34 from the slot 35 enables the supporting structure to be collapsed.

As shown in FIG. 1, the front and rear frames each comprise a pair of spaced waisted upright members 38 with upper and lower cross members 40, 41 respectively, therebetween. Each upright member 38 of the front frame is coupled to the corresponding upright member of the rear frame by a linkage structure which comprises a first link 43 pivoted to the front upright member, a second link 44 pivoted to the first link and to the rear upright member and a third link 46 pivoted to the second link 44 and to the front upper cross member. A spring 47 extending between the first and third members biases the linkage system into a collapsed position.

The erect position is defined by the abutment of a stop 50, positioned on the end of the first link beyond its pivot point with the second link, against the second link 44.

Each upright member 38 is provided at its lower end with adjustable feet 49 secured by screws 50 whereby the level of the working surface defined by the upper faces of the vise members 10 and 11 may be adjusted.

What I claim as my invention and desire to secure by Letters Patent is:

1. A portable workbench comprising:

a generally rigid frame including a spaced apart pair of elongated frame members having respective top surfaces;

a leg structure for supporting said frame above the ground;

a pair of elongated vice members supported from below by said frame and extending transversely to said elongated frame members;

the vice members having respective flat horizontal upper surfaces lying in substantially the same plane to form the complete uppermost working surface of the workbench;

the vice members further having respective, mutually adjacent clamping faces conjointly defining a gap therebetween; and, a clamping arrangement for moving the vice members apart and together for clamping a workpiece therebetween, the the clamping arrangement including:

a pair of clamping screws for moving one of the vice members relative to the other vice member;

the clamping screws being rotatably mounted in said frame beneath said top surfaces of said elongated frame members;

two nut-like structures threadably engaging respective ones of the clamping screws and having respective pins;

each of the elongated frame members having an elongated opening formed in said top surface thereof directly above the clamping screw therebeneath;

said elongated opening extending in a direction parallel to the longitudinal axis of the clamping screw and defining a track for slideably engaging the nut-like structure and for maintaining the pin thereof in an upward position substantially perpendicular to said plane as the nut-like structure is moved therealong in response to the rotational movement of the clamping screw;

means for confining said nut-like structures to move along the respective tracks in mutually parallel planes fixed with respect to said frame to prevent lateral movement of said nut-like structures within and relative to said respective tracks; and, aperture means formed in said one vice member for engagement with said pins; said aperture means being two apertures for engagement with respective ones of said pins, at least one of said apertures being an elongated slot thereby causing lateral movement between at least one of said nut-like structures and said one vice member when one of said clamping screws is rotated at a speed different than the other clamping screw whereby said clamping faces conjointly define a tapered gap therebetween.

* * * * *